United States Patent [19]

Nickerson et al.

[11] Patent Number: 4,974,314

[45] Date of Patent: Dec. 4, 1990

[54] CRIMPING TOOL HAVING SPRING LOADED CONTACT LOCATOR

[75] Inventors: Earl F. Nickerson, Langhorne, Pa.; John J. Students, Kenilworth, N.J.

[73] Assignee: Thomas & Betts Corporation, Bridgewater, N.J.

[21] Appl. No.: 414,873

[22] Filed: Sep. 29, 1989

[51] Int. Cl.[5] ..... H01R 43/04

[52] U.S. Cl. ..... 29/751; 72/410; 72/461

[58] Field of Search ..... 29/751, 753, 749; 72/461, 409, 410

[56] References Cited

U.S. PATENT DOCUMENTS

| | | | |
|---|---|---|---|
| Re. 28,509 | 8/1975 | Piechocki et al. | 228/180 |
| 315,636 | 4/1885 | King . | |
| 1,016,717 | 2/1912 | Smith . | |
| 2,340,360 | 2/1944 | Alden | 29/33 |
| 2,521,505 | 9/1950 | Doyle | 33/181 |
| 2,694,433 | 11/1954 | Fulton et al. | 153/1 |
| 2,929,433 | 3/1960 | Andren | 153/1 |
| 3,792,855 | 2/1974 | Bondie | 269/310 |
| 3,931,671 | 1/1976 | Dittmann | 29/753 |
| 3,957,185 | 5/1976 | Kauffman et al. | 228/106 |
| 4,426,128 | 1/1984 | Costello et al. | 339/276 |
| 4,443,936 | 4/1984 | Lazaro, Jr. | 29/863 |
| 4,736,614 | 4/1988 | Fryberger | 72/410 |

*Primary Examiner*—Carl E. Hall

*Attorney, Agent, or Firm*—Robert M. Rodrick; Salvator J. Abbruzzese

[57] ABSTRACT

A tool for crimping an elongate electrical contact to an end of an electrical wire. The tool includes a locating device supported adjacent the crimping dies of the crimping tool for supporting and locating the contact in proper position between the dies. Upon crimping, the contact is subject to deformable elongation in its longitudinal direction. The locating device is supported to the tool against the bias of the spring to be movable away from the tool to accommodate such contact elongation caused during crimping.

3 Claims, 2 Drawing Sheets

CRIMPING TOOL HAVING SPRING LOADED CONTACT LOCATOR

FIELD OF THE INVENTION:

The present invention relates to a crimping tool and a device attached thereto which supports an electrical contact adjacent crimping dies of the crimping tool. More particularly, the present invention relates to a locating device which is attached to a crimping tool under the bias of a spring and which is movable away from the tool to accommodate contact elongation during the crimping of the contact.

BACKGROUND OF THE INVENTION:

In the electrical connection art, crimping tools are widely known which crimp elongate electrical contacts to stripped ends of electrical wire. Simple hand tools of this type squeeze a barrel portion of the contact onto the stripped end of the wire. These hand tools employ plural crimping dies which are activated by the handles of the tool, to engage the contact in crimping fashion.

In typical operation, a contact is inserted between the dies and a stripped end extent of the wire is inserted into contact. Handles of the tool are then squeezed to crimp the wire in the contact. To assist the user in accurately supporting the contact between the dies, locating devices have been developed which attach to the tool adjacent dies to support the contact in proper position therebetween. Many of these locating devices have a stop surface preventing over insertion of the contact thereinto so that the barrel portion of the contact is positioned directly between the dies. While locating devices have been successfully used in combination with crimping tools, many of these devices, especially those having stop surfaces, fail to provide for accommodation of contact elongation. During the crimping process the barrel of the contact is compressed about the stripped end of the wire. Such compression causes the contact to deformably elongate in a longitudinal direction.

Locating devices having stop surfaces resist such elongation. This could result in damage to the contact or an ineffective crimp. It is advantageous to provide a contact locating device which is supportable on a crimping tool and which accurately supports the contact in proper position with respect to the crimping dies and which will accommodate contact elongation during crimping.

SUMMARY OF THE INVENTION

It is an object of the present invention to provide a crimping tool including a locating device which will properly position a contact adjacent crimping dies of the tool.

It is a further object of the present invention to provide a contact locating device for a crimping tool which will accommodate contact elongation which occurs during crimping.

In the efficient attainment of these and other objects, the present invention looks toward providing a tool for crimping an elongate electrical contact to the end of an electrical wire. The tool includes a tool body and die means supported by the body for crimping the contact. Actuation means is provided for moving the die means into engagement with the contact to crimp the contact to the wire. During such crimping, the contact is subject to deformable longitudinal elongation. The tool further includes locating means for supporting the contact adjacent the die means. The locating means is supported to the body under the bias of a spring for movement away from the body upon the longitudinal elongation of the contact.

DETAILED DESCRIPTION OF THE PREFERRED EMBODIMENT

Figure 1:
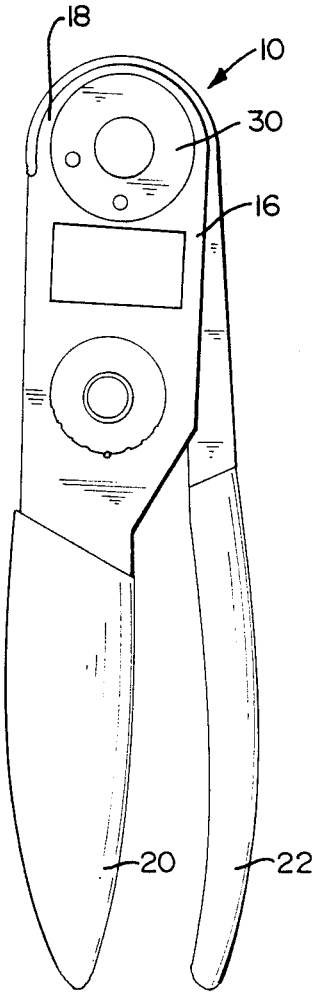
FIGS. 1, 2 and 3 show in front, side and rear plan views, respectively, a crimping tool of the present invention.
Figure 2:
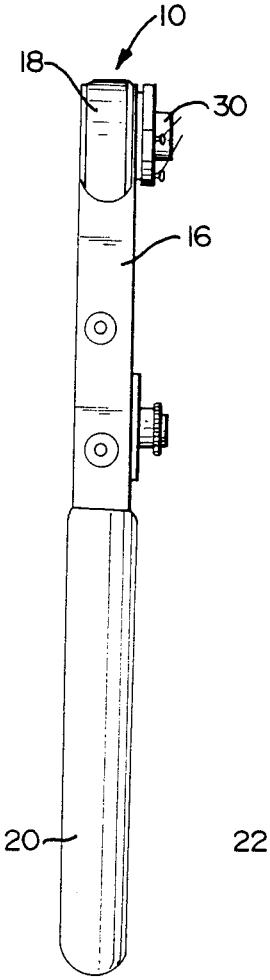
Figure 3:
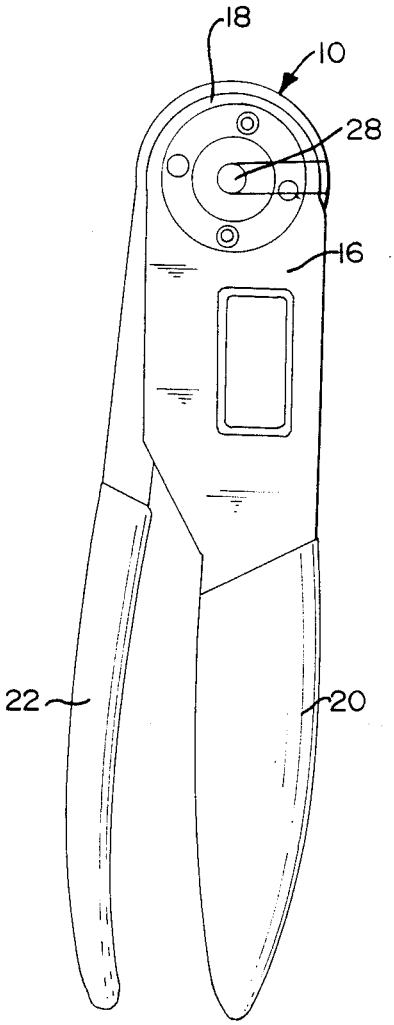
Figure 4:
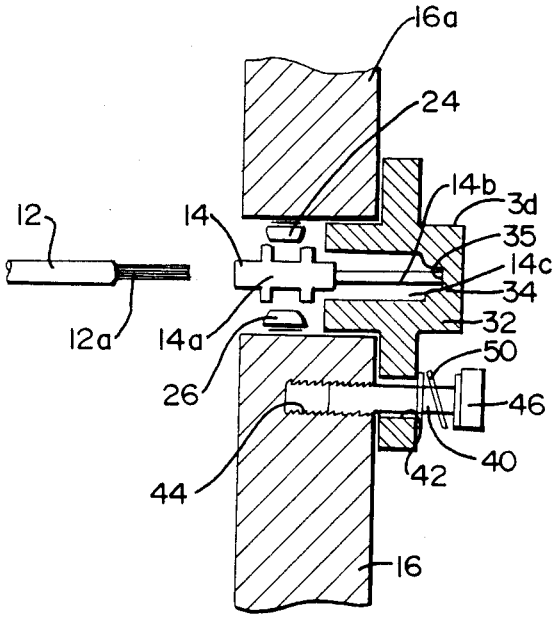
FIGS. 4 and 5 show schematically the operation of the crimping tool and locating device of the present invention.

Referring to FIGS. 1 through 3, crimping tool 10 of the present invention is of the type which is conventionally known in the electrical connection art useful for crimping an electrical wire 12 to an elongate electrical contact 14 shown in FIG. 4. Contact 14 is a conventional elongate cylindrical electrical contact having a barrel portion **14*a* which accommodates a stripped end 12*a* of an electrical wire 12. Contact 14 further includes a terminal portion 14*b*** used for interconnection purposes.

Crimping tool 10 includes an elongate tool body 16 having a nose portion 18 at one end and a pair of actuatable handles 20 and 22 at the other end thereof. Nose portion 18 houses a pair of oppositely directed crimping dies 24 and 26 shown schematically in FIGS. 4 and 5.

Figure 5:
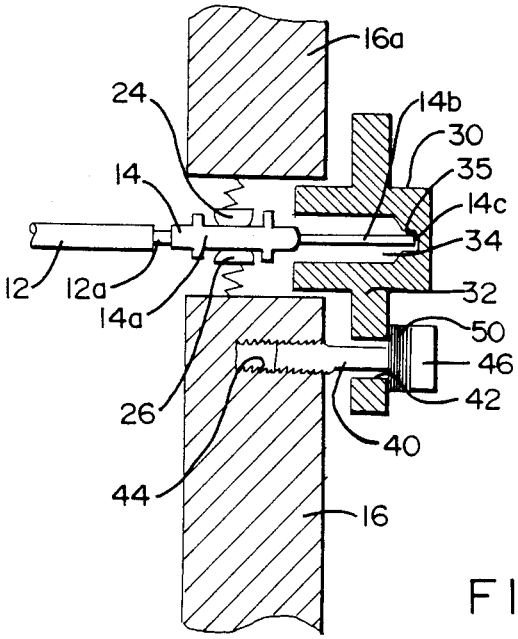

As shown in FIG. 3, a central aperture 28 in nose portion 18 provides for accommodation of both contact 14 and electrical wire 12. Crimping tool 10 is operated in a manner conventionally known in the art. Contact 14 is inserted in aperture 28 so as to position barrel portion **14*a* between dies 24 and 26 (FIGS. 4 and 5). The stripped end 12*a* of electrical wire 12 is inserted into the barrel portion 14*a* of contact 14 and the tool is operated by actuation of handles 20 and 22 to cause dies 24 and 26 to crimp barrel portion 14*a* about the stripped end 12*a* of electrical wire 12. Release of the handles 20 and 22 provide for release of dies 24 and 26 so that the wire 12 crimped to contact 14 may be removed from crimping tool 10**.

The tool 10 of the present invention further includes a contact locating device 30 shown in FIGS. 1 and 3 and schematically in FIGS. 4 and 5. Locating device 30 is supported adjacent nose portion 18 of tool 10. Locating device 30 is supported on one side **16*a* of tool body 16 so as to permit full operation of dies 24 and 26. Locating device 30 is a metallic member having a generally circular configuration which is adapted to fit conveniently adjacent nose portion 18 of tool 10**.

Referring more specifically to FIGS. 4 and 5, locating device 30 includes a main body 32 having a generally elongate cylindrical cavity 34 therethrough. Cylindrical cavity 34 accommodates contact 14 therein. Cylindrical cavity 34 includes a stop surface 35 adjacent one end thereof which provides for accurate positioning of contact 14 therein as will be described in detail hereinbelow. Locating device 30 is supported on tool body 16 for movable disposition with respect thereto by one or more fastening screws 40. Each of fastening screws 40 is passed through an aperture 42 of main body 32 of locating device 30. Each fastening screw 40 is then screw inserted into an internally threaded opening 44 in tool body 16 to secure locating device 30 thereto.

Movable positioning of locating device 30 is provided by a spring 50 which is interposed between main body 32 of locating device 30 and the head 46 of screw 40 so that locating device 30 is spring biased against one side 16*a* of tool body 16. In this position, locating device 30 is movable against the bias of spring 50 away from side 16*a* of tool body 16.

Having described the structure of the tool 10 of the present invention its operation may now be described.

Initially, contact 14 is inserted into aperture 28 of tool 10. Contact 14 is inserted until a front end extent 14*c* of contact 14 abuts against stop surface 35 of locating device 30. In this position, barrel portion 14*a* of contact 14 will be positioned directly between the opposed dies 24 and 26 of tool body 16. Electrical wire 12 having a strip end 12*a* is inserted into the barrel portion 14*a* of contact 14.

Referring to FIG. 5, by actuation of handles 20 and 22, dies 24 and 26 are brought down into crimping engagement with barrel portion 14*a* thus deforming barrel portion 14*a*. Such deformation causes contact 14 to elongate along its longitudinal extent, since during crimping, barrel portion 14*a* will be fixably held within dies 24 and 26. Elongation will tend to occur in a direction toward front end extent 14*c* of contact 14. Since front end extent 14*c* is abutted against stop surface 35 of locating device 30, elongation of the contact will cause the locating device 30 to move away from side 16*a* of tool body 16 against the bias of spring 50. Thus, the longitudinal elongation caused by crimping deformation will be accommodated by the movable securement of locating device 30 to tool body 16.

Once crimping has occurred, handles 20 and 22 are released thus releasing dies 24 and 26. Release of dies 24 and 26 will permit locating device 30 to spring back against side 16*a* of tool body 16. Wire 12 with connector 14 crimped thereto may be removed from the tool.

The locating device 30 of the present invention may be used in configurations other than that shown herein and may be used with other crimping tools.

Various changes to the foregoing described and shown structures would now be evident to those skilled in the art. Accordingly, the particularly disclosed scope of the invention is set forth in the following claims.

We claim:

1. An apparatus for terminating an electrical wire with an elongate electrical contact having a crimpable wire receiving portion and a terminal end, said contact being subject to deformable longitudinal elongation upon crimping, said apparatus comprising:

a crimping tool having a tool body, die means for crimping said wire receiving portion of said contact, and actuation means for moving said die means into crimping engagement with said wire receiving portion of said contact; and locating means for locating and supporting said contact adjacent said die means, said locating means being movably mounted on said tool body under the bias of a spring, said locating means including a stop surface for engaging said terminal end thereby locating the crimpable portion relative to said die means and for allowing, upon said longitudinal contact elongation, said longitudinal contact elongation to cause movement of said locating means, against said spring bias, away from said tool body.

2. An apparatus of claim 1 wherein said locating means includes a main body and a longitudinal cavity therein for receipt of said contact, said cavity having said stop surface at one end thereof.

3. An apparatus of claim 2 wherein said locating means is movable toward said body under said spring bias.

* * * * *